United States Patent [19]

McKinnon et al.

[11] 3,988,709

[45] Oct. 26, 1976

[54] ELECTRIC MOTOR CONTROLLING RELAY

[75] Inventors: Eugene T. McKinnon, Pacific Palisades; Alvin S. Drutz, Los Angeles; Randall C. Danta, Reseda, all of Calif.

[73] Assignees: Eugene T. McKinnon, Pacific Palisades; Alvin S. Drutz, Los Angeles, both of Calif. ; part interest to each

[22] Filed: May 12, 1975

[21] Appl. No.: 576,550

[52] U.S. Cl. ..... 338/57; 317/13 C; 338/220

[51] Int. Cl.[2] ..... H01C 1/08

[58] Field of Search ..... 338/57, 220; 317/13 C

[56] References Cited

UNITED STATES PATENTS

| | | | |
|---|---|---|---|
| 3,750,082 | 7/1973 | Petersen et al. | 338/57 |
| 3,842,188 | 10/1974 | Petersen | 338/57 |
| 3,925,748 | 12/1975 | Slocum | 338/57 |

*Primary Examiner*—Harold Broome

*Attorney, Agent, or Firm*—Mahoney, Schick & Cislo

[57] ABSTRACT

A thermistor sandwich assembly connectable for controlling motor starting windings is enclosed in a relatively thin and conforming case. The sandwich assembly includes a contact plate abutting the case lower wall with plate integral spring fingers against a face of a wafer-like thermistor, another contact plate overlying and having downward projections against the other thermistor face as well as abutting the upper case wall. A plurality of holes in the lower case wall and a bus bar slot through the upper case wall permit air circulation through the case and between the contact plates and thermistor faces for cooling the thermistor, the relay being otherwise free of cooling plates. A bus bar is rigidly connected extending partially through the case bus bar slot in electrical connection with the thermistor sandwich assembly normally transmitting electrical energy to a contact plate but selectively severable or removable to permit addition of capacitance in the electrical circuit.

14 Claims, 7 Drawing Figures

CAP
S
M
L
66
64
12
68
52
24
56
54
46
22
48
50
44
18
38
40
42
42
40
20
26
22
50
36
14
30
34
32
32
34
16
62
62
10
60
58
62
62

ELECTRIC MOTOR CONTROLLING RELAY

BACKGROUND OF THE INVENTION

This invention relates to an electric motor controlling relay of the type for controlling the starting windings of an electric motor and according to the principles of the present invention may include a much more compact and simplified construction and overall assembly than has heretofore been possible in similar devices, one result being the necessary inclusion of less component parts yet while maintaining a maximum efficiency of intended performance and use. Furthermore, the relay of the present invention may include a unique component formation, positioning and case containment providing efficient air circulation cooling for the typical thermistor incorporated therein and eliminating the usual requirement of auxiliary cooling plates for proper functioning of such thermistor, again adding to the compactness and simplification of the overall assembly. Still in addition, the relay of the present invention may include a unique form of bus bar incorporated rigidly mounted in the assembly normally serving as a part of the usual electrical transmission circuit therethrough, but at the same time, being conveniently accessible and selectively convertible to permit the connection of capacitance into the assembly electrical circuit where such is required.

Various forms of relays and similar devices have heretofore been used for controlling the split-phase starting windings of single-phase electric motors, for instance, the electric drive motors of refrigerators and similar mechanisms. Generally, the functioning of the relay is to maintain the starting windings of the electric motor connected or energized for approximately 3/10 second to ½ second during the starting of the motor and at that time, de-energize or cut out the starting windings from the motor circuit which would normally be prior to the motor reaching full running speed. In this manner, the relay automatically controls the provision of additional torque for the electric motor during the starting thereof while automatically removing or eliminating such additional torque just prior to the time that the electric motor will normally reach full speed where such additional torque is not necessary. However, in such electric drive motor starting, there are occasions where the initial load on the motor at the time of such starting is excessive such as can not infrequently occur in refrigeration units and in this case, automatic current overload and/or heat overload controls of the motor immediately interrupt electrical power thereto, the important point being that when such occurs, the particular relay controlling the motor starting windings must be constructed such that it will be ready to again perform its starting winding controlling function by the time that the motor is once again ready to attempt to start.

One of the more commonly used form of relays applied to the foregoing purposes in the present modern times incorporates a thermistor, that is, a resistor making use of a semi-conductor whose electrical resistance varies sharply in a preplanned manner with the temperature thereof. The required characteristics in the present instance will be that the thermistor will initially transmit electrical energy therethrough at virtually full current and will continue to transmit nearly such full current therethrough until the current transmission heats the same to a given temperature, at which time, the thermistor will instantaneously sharply increase its resistance to reduce the current transmission therethrough to a minimal amount. Thus, by providing the thermistor in wafer-like form and transmitting the electrical energy therethrough by abutting contact with metal contact plates against the faces of the thermistor, the thermistor is connected into the electrical circuitry of the motor starting windings so as to transmit the electrical energy at nearly full current for the approximately 3/10 second to ½ second while the motor comes up to full speed and then automatically reduce the current to a minimal amount just prior to the motor reaching full speed.

Preceding the development of these more modern thermistor-type relays, the starting windings of the same electric drive motors were normally controlled by a centrifugally regulated relay built directly into the drive motor structure so that it can be seen that the advent of this thermistor-type relay has advantageously decreased the size and complexity of the equivalent electric drive motors. Although the thermistor-type relays require mounting exterior of the electric drive motor housings, the inherent simplicity and compactness of these relays has permitted the mounting thereof in relatively small space areas. This is particularly critical due to the relatively long standing trend toward miniturization and compactness designed into the presently marketed devices. At the same time, such exterior mounting provides the advantage of ready accessibility and simple replacement in the event of malfunctioning or changing demand conditions, such convenience not being present with the prior relays incorporated internally of the electric drive motor.

Despite the limited size and compactness of the presently marketed thermistor-type relays prior to the unique structure of the present invention, however there is still the desirability to even further reduce the size and compactness thereof to permit more convenient exterior mounting, as well as to reduce the electrical circuitry thereof to a minimum number of parts for both cost savings and increased efficiency of operation less subject to malfunction and other failure. For instance, keeping in mind the inherent operation of the thermistor requiring a temperature rise therein generated by current flow therethrough to perform its current flow controlling function as hereinbefore described, the prior thermistor-type relays have made use of metal heat dissipation plates in addition to the normal electrical circuitry contact plates. As stated, whatever relay is being used to control the starting windings of the particular electrical drive motor, if starting difficulties are encountered and the overload controls of the motor are activated, when these overload controls are sufficiently cooled to permit attempted restarting, the particular relay must likewise be ready for such motor starting. In the case of a thermistor-type relay, of course, this means that the thermistor must likewise have sufficiently cooled to be in an initial starting condition and to augment such cooling, the metal heat dissipation plates in conjunction with the normal electrical circuit contact plates have been used.

Furthermore, with the prior thermistor-type relays not only have heat dissipation plates been required in addition to the electrical circuitry contact plates and thermistor itself, but a still further component has been required in order to force the contact plates against the thermistor faces so that proper electrical contact is at all times maintained. In the prior constructions, this has usually taken on the form of some type of spring compression member which abuts and acts against one of the contact plates. With the one contact plate forced and maintained tightly abutting the one thermistor face, the thermistor is thereby forced against the other contact plate and the electrical circuitry is established and maintained. Again, the addition of an added component within the relay which is not only space consuming, but adds to the expense of fabrication and assembly.

Still a further area which warrants efforts of possible improvement in the prior thermistor-type relays presently being marketed has to do with the addition into the relay circuitry of capacitance. Not infrequent situations in matching loads with proper fractional horsepower electric drive motors are encountered where hard starting problems are encountered and the addition of capacitance to the relay electrical circuitry can greatly improve these conditions, usually with the larger motors such as those in the ¼ horsepower to ⅓ horsepower range. In most cases with the prior thermistor-type relays, such capacitance has been supplied merely by randomly adding the same to the outside electrical circuitry either to or from the particular relay. This obviously can result in problems of proper electrical connection, as well as deter efforts toward the vital compactness and serviceability.

OBJECTS AND SUMMARY OF THE INVENTION

It is, therefore, an object of this invention to provide an electric motor controlling relay of the type for controlling motor starting windings which may incorporate the important sought after qualities of maximum compactness and maximum simplification primarily as a result of the requirement of less component parts. According to certain of the principles of the present invention, one of the prime attributes of the thermistor-type relay herein presented is that the thermistor in its wafer-like form and its oppositely face contacting contact plates make up a fully operably thermistor sandwich assembly which is maintained in efficient and positive electrical contact operation without the necessity of additional assembly components, such as the additional spring compression member required in the prior constructions. In the preferred form of the present thermistor sandwich assembly, at least one of the contact plates serves as the usual electrically transmitting contact plate, but also equally well serves as the compression member or plate by having resiliently compressible means formed directly thereon and against its particular thermistor face for exerting compressive forces in the assembly to maintain such sandwich assembly in sound electrical connection.

It is another object of this invention to provide an electric motor controlling relay of the type for controlling motor starting windings and incorporating a thermistor as its prime operating component thereof which may further incorporate a unique form of air circulation cooling means for such thermistor in its usual functioning, thereby eliminating the necessity of added cooling plates and again contributing to maximum compactness and simplification of the overall assembly. Still in the preferred form of the present invention, the case of the relay is formed with spaced, generally opposed walls each having air circulation openings formed therethrough. In addition, the thermistor sandwich assembly contained within the case not only has the contact plates abutting and in electrical contact with the opposed thermistor faces, but also has air circulation space means formed between the thermistor faces and such contact plates, which, most importantly, are in air circulation communication with these case wall openings. In this manner, the thermistor is efficiently cooled as is required during the functioning thereof without the necessity of additional cooling plates or other cooling means.

It is still a further object of this invention to provide an electric motor controlling relay of the type for controlling motor starting windings and incorporating a thermistor as the prime operating component thereof which may still additionally incorporate a unique construction and mounting of bus bar means forming a part of the usual electrical transmission circuitry thereof and which provides convenient selective conversion permitting the addition of capacitance to the circuitry where desirable. The prime attributes of this bus bar means when incorporated in the relay of the present invention are those of rigidity in mounting so as to form virtually an integral part of the case enclosed relay assembly while being conveniently positioned so as to be easily accessible in the event the conversion advantages thereof are to be availed of for the adding of the desired capacitance. For instance, in a preferred form thereof, the bus bar means may be a metal bus bar mounted outwardly adjacent the relay cause and preferably partially extending into the case through a convenient slot opening thereof. In such position, the bus bar is rigidly connected into the electrical circuitry to one of the contact plates so as to perform the usual function of transmitting electrical energy therethrough in the relay electrical circuitry. However, in the event that it is desired to add capacitance to the relay electrical circuitry, the bus bar may be additionally formed slideably connected, or conveniently severable, or both so that the electrical circuit therethrough may be selectively interrupted by one manner or the other and replaced by the required capacitance to be added to the relay for the purposes hereinbefore discussed.

It is an additional object of this invention to provide an electric motor controlling relay of the type for controlling motor starting windings which may incorporate any one or all of the foregoing advantageous features of construction, while still may be presentable in a relatively thin case of minimum size and maximum mounting convenience, particularly beneficial due to the minimum size of the usual accessible mounting spaces available in the various devices according to modern design. Still again in the preferred embodiment of the present invention, the relay case enclosing the unique thermistor sandwich assembly has its upper and lower walls of relatively large area with the other walls thereof being side edge walls of minimum area. Thus, the space volume occupied by the overall relay assembly is at a minimum and the relay of the present invention may be conveniently mounted in minimum spaces not heretofore possible with the prior similar constructions.

Other objects and advantages of the invention will be apparent from the following specification and the accompanying drawings which are for the purpose of illustration only.

Figure 1:
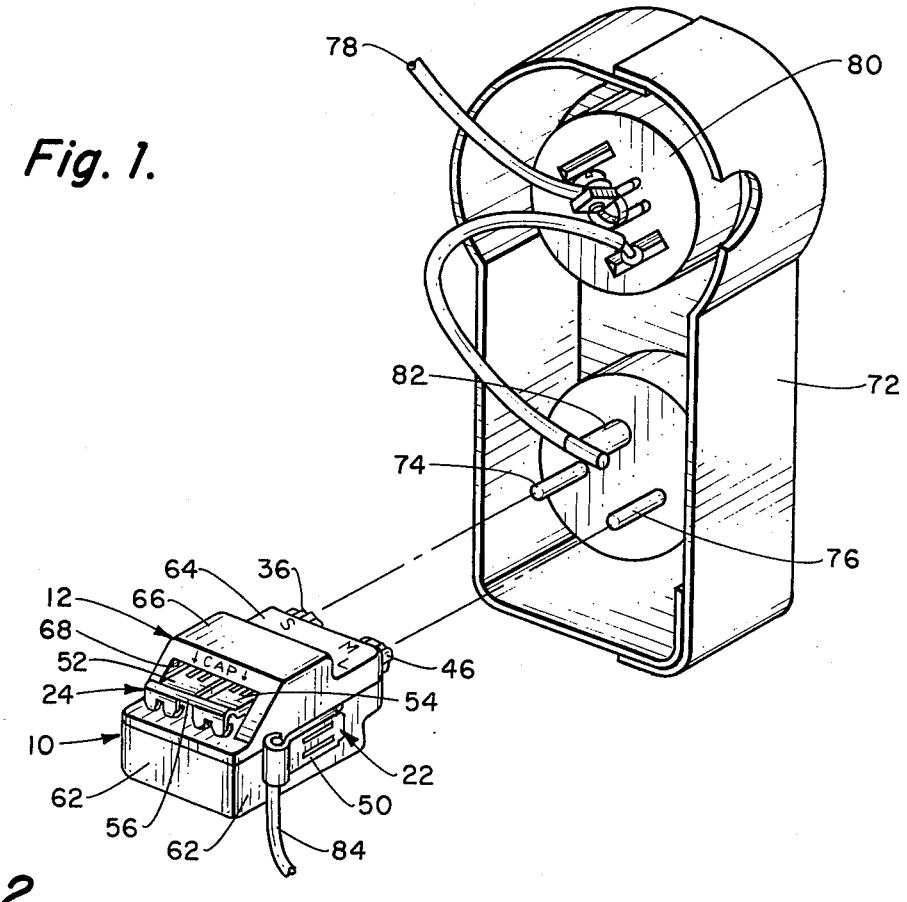
FIG. 1 is a perspective view showing a preferred embodiment of the motor controlling relay of the present invention ready for connection into the electrical circuitry of a usual electric terminal box of an electric motor.

DESCRIPTION OF THE BEST EMBODIMENT CONTEMPLATED:

Referring to the drawings, a preferred embodiment of the electric motor controlling relay of the present invention is shown therein and includes a somewhat rectilinear, plastic case body generally indicated at 10 and a matching plastic case cap or top generally indicated at 12 enclosing for the main part the various components making up the relay. Furthermore, such relay components preferably include a thermistor sandwich assembly generally indicated at 14 comprised of lower and upper metal contact plates generally indicated at 16 and 18 separated by a wafer-like typical thermistor generally indicated at 20, a metal main power connector generally indicated at 22, and a metal bus bar generally indicated at 24, all of which will be hereinafter more particularly described as will be the case body and cap 10 and 12. All of the elements of the relay, however, are formed of usual materials and by usual manufacturing processes appropriate for the purposes intended, except as hereinafter specifically pointed out.

More particularly to the thermistor sandwich assembly 14, the thermistor 20 thereof is as indicated wafer-like or disc-like preferably having substantially flat upper and lower surfaces or faces 26 and 28 with a circular periphery in plan view as shown. The heat sensitive resistance characteristics of the thermistor are generally that the thermistor will conduct substantially full electric current therethrough initially to the starting windings of the electric motor being controlled by the relay at room temperature and will continue to conduct substantially full current for a period of approximately 3/10 second to 5/10 second while the current passing therethrough is heating the same, after which, the resistance thereof will virtually instantaneously increase reducing the current flow therethrough to very nearly nothing, at the most a mere trickle. Obviously, the characteristics of the relay of the present invention will vary dependent on the particular intended use of the relay. The particular construction of the thermistor 20 for use herein or the many variations thereof adapted for other intended uses are well-known to those skilled in the art and such thermistors are readily available on the commercial market.

Figure 3:
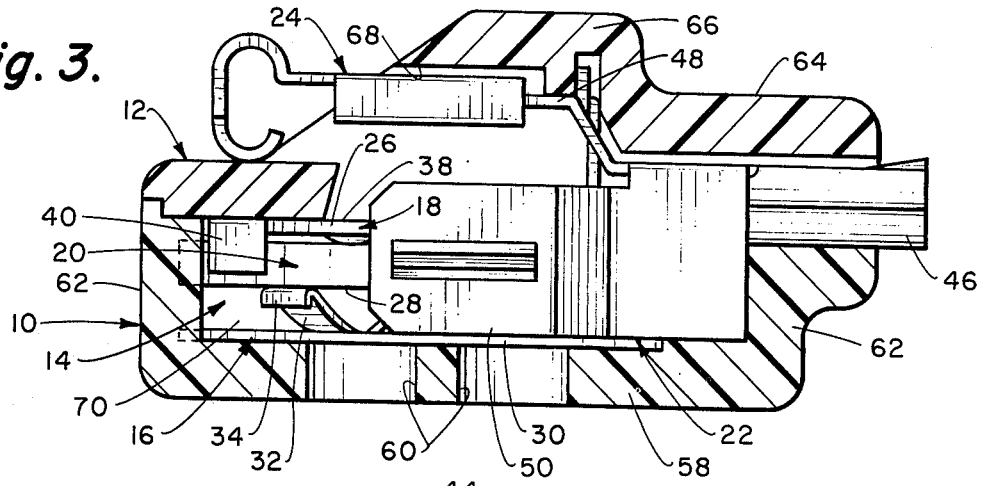
FIG. 3 is an enlarged, vertical sectional view looking in the direction of the arrows 3—3 in FIG. 2.
Figure 4:
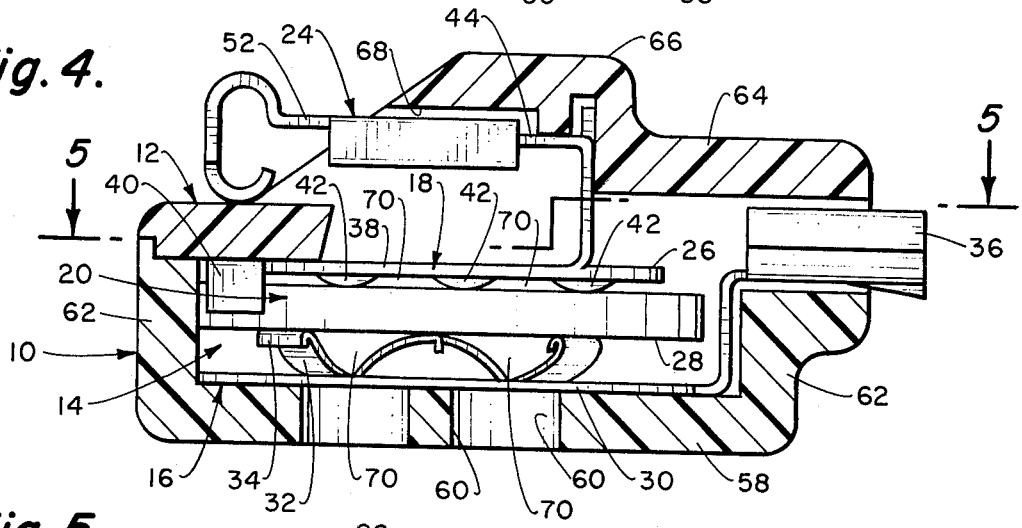
FIG. 4 is an enlarged, vertical sectional view looking in the direction of the arrows 4—4 in FIG. 2.
Figure 6:
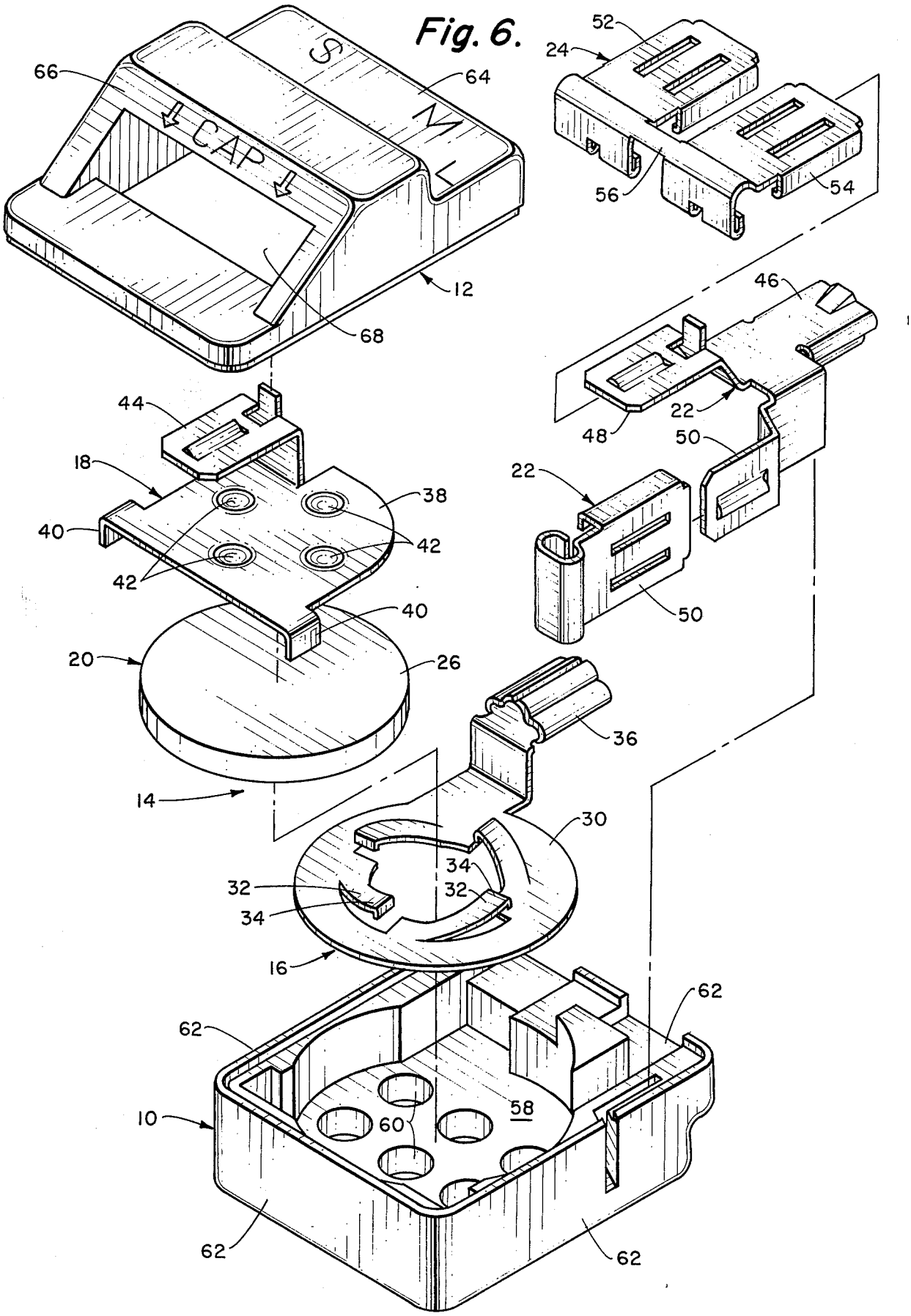
FIG. 6 is an enlarged, perspective, exploded view of the relay of FIG. 1 and showing the various components thereof in more detail.

The lower contact plate 16 of the thermistor sandwich assembly 14, as best seen in FIGS. 3, 4 and 6, is preferably formed of one piece of an appropriate electrically conducting metal with reasonable resilience, such as, a silver plated brass alloy approximately ½ hard. As shown, the lower contact plate 16 includes a substantially flat, perferably annular, main part 30 preferably generallly circular in plan view and terminating radially inwardly in a plurality of four, equally spaced and circumferentially extending, spring fingers 32. The integral spring fingers 32 project progressively upwardly away from the main part 30 terminating in slightly rolled end contact parts 34. A starting winding terminal 36, in this case a female terminal, is formed integrally projecting rearwardly and upwardly offset from the main part 30 as shown.

The upper contact plate 18 of the thermistor sandwich assembly 14 is formed of material similar to the lower contact plate 16 and has a generally rectangular main part 38 with forward corner, outwardly and downwardly extending positioning tabs 40. Furthermore, a plurality of four, equally spaced, contact dimples 42 are formed projecting downwardly on the main part 38. The one piece upper contact plate 18 is completed by an upwardly offset and forwardly extending bus bar terminal 44, in this case a male terminal, which thereby overlies the upper contact plate as shown.

Completing the components of the relay other than the thermistor sandwich assembly 14, the main power connector 22 and the bus bar 24 are both formed of materials similar to the contact plates 16 and 18 of the thermistor sandwich assembly. The main power connector 22 has the opposed main winding terminal 46 extending rearwardly and bus bar terminal 48 extending forwardly and vertically offset, in this case, the main winding terminal being a female terminal and the bus bar terminal being a male terminal. Intermediate between the main winding and bus bar terminals 46 and 48, the main power connector 22 is also formed with a transversely and downwardly offset, forwardly extending main power terminal 50, in this case, a male terminal. The bus bar 24 is formed by transversely spaced and aligned contact plate terminal 52 and connector terminal 54, in this case, both female terminals, and transversely connected by a transverse bar 56.

The case body 10 and case cap 12 are both formed of an appropriate plastic having well-known dielectric qualities for proper insulation. The case body 10 is formed with a flat bottom wall 58 having a plurality of spaced openings 60 formed therethrough, peripherally surrounded by upwardly projecting side walls 62, the bottom wall extending transversely over a relatively wide area as compared to the individual areas of the side walls in their vertical extents. The case cap 12 upwardly closes the case body 10 essentially forming an upper wall 64 having an intermediate raised part 66 opening forwardly through a transversely elongated bus bar slot 68. The side walls 62 of the case body 10 and the upper wall 64 of the case cap 12 are appropriately inwardly contoured, as are the side walls appropriately slotted, for functionally retaining the components of the relay in assembly as will be hereinafter described, and it is pointed out that both the bottom or lower and upper walls 58 and 64 include areas of horizontal surface to act as vertically confining abutments for such assembly.

Figure 5:
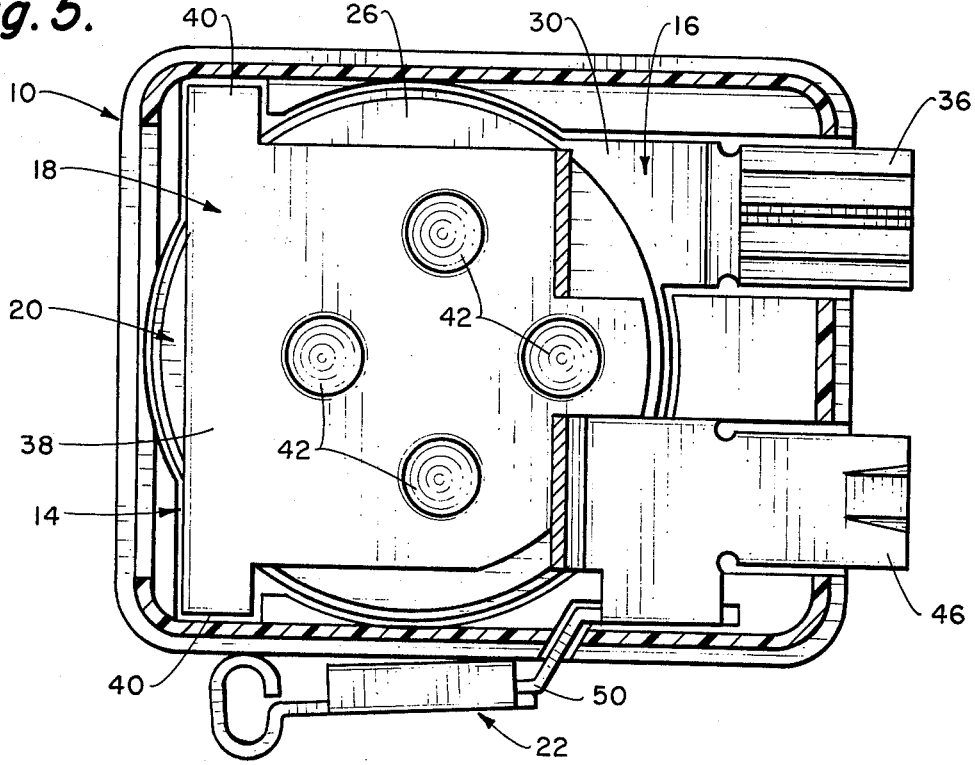
FIG. 5 is a horizontal sectional view looking in the direction of the arrows 5—5 in FIG. 4.

With the case cap 12 removed from the case body 10, the thermistor sandwich assembly 14 is assembled in the case body as best seen in FIGS. 3 through 5 by abutting the main part 30 of the lower contact plate 16 downwardly against the case body bottom wall 58 with the spring fingers 32 projecting upwardly and the starting winding terminal 36 projecting rearwardly. The thermistor 20 is positioned with its lower face against the end contact parts 34 of the lower contact plate spring fingers 32 and its upper face facing upwardly. The upper contact plate 18 is abutted downwardly against the upper face of the thermistor 20, that is, the upper contact plate dimples 42 downwardly contact the thermistor while the main part 38 retains the same positioned through the positioning tabs 40 with the bus bar terminal 44 projecting forwardly.

Figure 2:
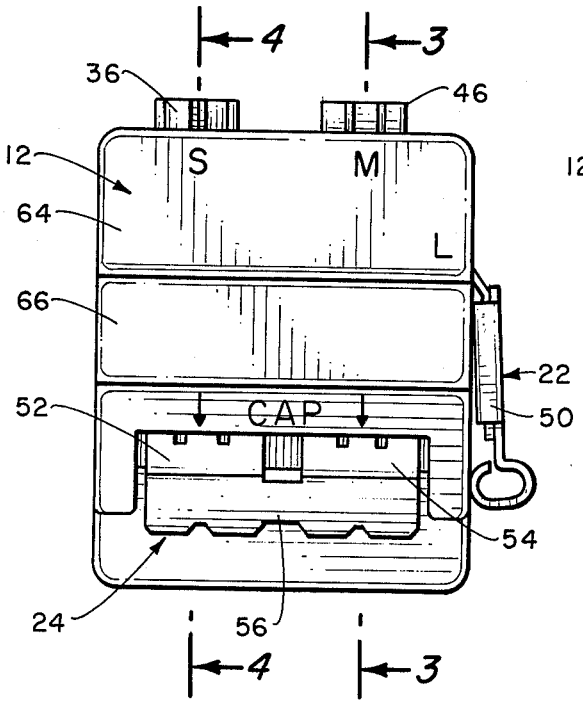
FIG. 2 is an enlarged, top plan view of the relay of FIG. 1.

The assembly is completed by the positioning of the main power connector 22 extending through the right case body side wall 62, that is, as best seen in FIGS. 1, 2 and 5 with the main winding terminal 46 extending internally rearwardly, the bus bar terminal 48 extending internally forwardly and the main power terminal 50 extending forwardly outwardly adjacent the side wall, and finally the case cap 12 is placed overlying the case body 10. In such final assembly, the case cap 12 is forced downwardly against the case body 10 to thereby vertically compress the thermistor sandwich assembly 14 permitted by the resiliency of the spring fingers 32 on the lower contact plate 16. The case cap 12 is peripherally joined to the case body 10 in usual manner, that is, by heat sealing or by common adhesive securement. The contact plate and connector terminals 52 and 54 of the bus bar 24 are then inserted into the bus bar slot 68 of the case cap 12 being slid onto and in electrical contact with the bus bar terminal 44 of the upper contact plate 18 and the bus bar terminal 48 of the main power connector 22.

In the final assembly of the preferred embodiment of the relay of the present invention, it will be noted that the starting winding terminal 36 of the lower contact plate 16 and the main winding terminal 46 of the main power connector 22 both extend rearwardly through the rearward side wall 62 of the case body 10 so as to be exposed side by side in specific location for a purpose to be hereinafter pointed out. Also, it will be noted that the spring fingers 32 retain the main part 30 of the lower contact plate 16 spaced away from the corresponding face of the thermistor 20 and the dimples 42 retain the main part 38 of the upper contact plate 18 spaced away from the corresponding face of the thermistor 20. Not only are the spring finger and dimple contacts with the thermistor faces generally vertically aligned to minimize stresses in the thermistor 20, but very important, such spacing provides air circulation openings 70 between the respective contact plates and the thermistor faces which are in communication with the bottom wall openings 60 of the case body 10 through the central portion of the lower contact plate and the bus bar slot 68 of the case cap 12 around the sides of the upper contact plate and through the case cap raised part 66 for a further purpose to be hereinafter described. Still further, it will be noted that in the assembly, the bus bar 24 projects forwardly from and is fully accessible at the bus bar slot 68 of the case cap 12 so that the transverse bar 56 joining the terminals 52 and 54 thereof is conveniently accessible as is the bus bar easily removable if desired, again for a purpose to be hereinafter described.

In operation of the preferred embodiment of the relay of the present invention, the assembled relay is inserted rearwardly into a usual terminal box 72 of an electric motor to be controlled as indicated by the phantom directional lines in FIG. 1. During such insertion, the starting winding terminal 36 of the lower contact plate 16 is rearwardly slideably received over a starting winding pin terminal 74 of the terminal box 72 which is electrically connected to the starting windings of the motor, while the main winding terminal 46 of the main power connector 22 is rearwardly slideably received over a main winding pin terminal 76 of the terminal box which is electically connected to the main windings of the motor. In the terminal box 72, a first main power input line 78 is electrically connected through a usual motor overload protector 80 and into the motor windings through a main power input terminal 82. Thus, upon electrical connection of a second main power input line 84 to the relay outer main power terminal 50 of the main power connector 22, the relay is electrically connected ready for performing its intended motor controlling function in controlling the starting windings of the motor.

In the internal electrical circuitry of the relay, main electrical power is connected through the main power terminal 50 of the main power connector 22 and from such connector rearwardly through the main winding terminal 46 into the main windings of the motor as well as forwardly from such connector into the bus bar terminal 48 of such connector. From the connector bus bar terminal 48, the main power is directed through the bus bar 24 into the bus bar terminal 44 of the upper contact plate 18, downwardly through the thermistor 20 to the lower contact plate 16 and ultimately into the motor starting windings through the starting winding terminal 36 of the lower contact plate. This direct transmission through the bus bar 24 is assuming that no added capacitance is needed in the relay circuit as will be hereinafter discussed.

In starting of the electric motor, therefore, initial electric power is directed through the relay at full current, passing through the thermistor sandwich assembly 14 as initially transmitted by the thermistor 20 to the motor starting windings, and at the same time, main electrical power is transmitted directly through the relay through the main power connector 22 thereof to the motor main windings. After full current transmission of the electrical power through the thermistor sandwich assembly 14 of the relay for approximately 3/10 second to 5/10 second depending on the planned characteristics of the thermistor 20, the thermistor in its usual functioning and by virtue of current heating thereof instantaneously virtually blocks further main power flow through the relay to the motor starting windings at near full speed operation of the motor. Assuming normal load on the motor and no starting difficulties, the motor is immediately thereafter at full running speed and continues operation thereof solely on the motor main windings.

If, however, there is a temporarily excessive load on the motor preventing proper initial starting thereof, the motor overload protector 80 will quickly cut off all main power to the motor which will likewise interrupt the main power flow through the relay and the motor overload protector will remain in this condition for a period of cooling time before permitting an attempted restarting of the motor. During this period of time, it is also necessary for the relay to cool, that is, the thermistor 20 thereof, in order that the relay will be in proper condition for properly energizing the motor starting windings during another attempted start. This cooling of the thermistor 20 is uniquely primarily accomplished by the preplanned air circulation through the relay case body and cap 10 and 12. The cooling air may freely circulate through the case body bottom wall openings 60, through the lower contact plate 16 and around the thermistor faces, around the upper contact plate 18 and through the case cap bus bar slot 68.

Figure 7:
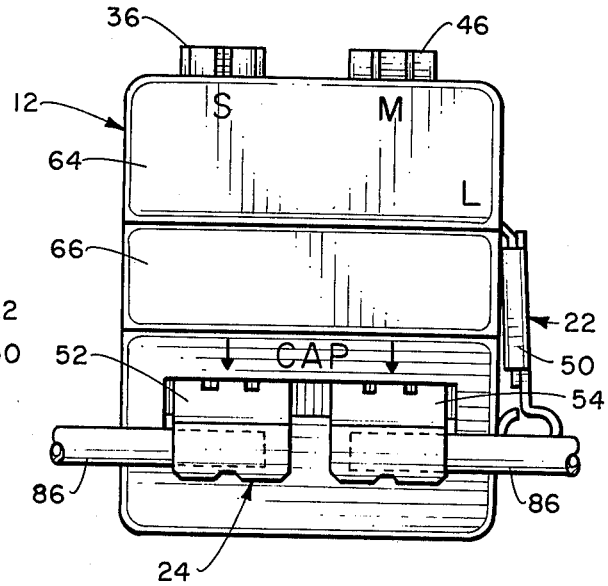
FIG. 7 is a view similar to FIG. 2 showing the relay of FIG. 1 in a converted form and having the leads of a typical capacitor connected into the electrical transmission circuitry thereof.

If conditions dictate and it is desired to add capacitance to the electrical power input to the motor starting windings, for instance, as a result of motor hard starting difficulties, such capacitance can be quickly added to the relay circuitry by the removal of the transverse bar 56 of the bus bar 24 and the connection of the capacitance at this point. This can be accomplished either by complete slideable removal of the bus bar 24 and the connection of the capacitance in its place across the bus bar terminal 48 of the main power connector 22 and the bus bar terminal 44 of the upper contact plate 18. However, in the preferred embodiment of the relay illustrated herein, it is most convenient merely to sever the transverse bar 56 of the bus bar 24 from between the contact plate and connector terminals 52 and 54 thereof as shown by comparison of FIGS. 2 and 7 with leads 86 of the capacitance being properly electrically connected as shown placing the capacitance properly in the relay circuitry for performing its intended function.

According to the present invention, therefore, an electric motor controlling relay of the type for controlling motor starting windings is herein provided wherein the required operational components thereof are reduced to a minimum while still maintaining highly efficient functioning thereof for its intended purpose. Any one or all of the unique features disclosed contribute thereto resulting in a highly compact relay with distinct cost reduction. For instance, the elimination of the usual separate pressure plate by the provision of resilient pressure means directly associated with the lower contact plate 16 of the thermistor sandwich assembly 14, the elimination of heat dissipation plates by the direct incorporation of air circulation spaces and openings in and through the thermistor sandwich assembly 14 and through the provided openings of the case body and cap 10 and 12, and the provision of the compactly and rigidly mounted bus bar 24 which can be readily converted for convenient incorporation of capacitance into the relay circuitry, all contribute to the compactness and efficiency goals. The added result is that the unique relay of the present invention may be packaged in a case body and cap 10 and 12 which is of a uniquely thin and space-saving contour, relatively large area case upper and bottom walls are compared to relatively thin and small area side walls, making possible the mounting of the overall relay in formerly inaccessible mounting spaces important to electric motor modern installations.

We claim:

1. In an electric motor controlling relay of the type for controlling motor starting windings; the combination of: a case; a thermistor sandwich assembly in said case comprising a wafer-like thermistor with contact plates at opposite faces thereof in abutting electrical contact therewith, one of said contact plates having resiliently compressible means thereon against its thermistor face for exerting compressive forces in said assembly between said contact plates, said resiliently compressible means of said one contact plate being a plurality of equally spaced and circumferentially extending spring fingers formed integral on said one contact plate, said spring fingers extending generally toward and contacting said one contact plate thermistor face at spaced locations thereon, the other of said contact plates having a plurality of projections formed integrally thereon and extending toward its thermistor face, said projections contacting said other contact plate thermistor face at locations generally aligned with said locations of said contact by said one contact plate spring fingers; surface means on said case oppositely abutting said sandwich assembly contact plates for retaining said compressive assembly; electrical transmission means operably connected to each of said sandwich assembly contact plates for transmitting electrical energy through said sandwich assembly.

2. In an electric motor controlling relay of the type for controlling motor starting windings; the combination of: a case having bus bar opening means through a wall thereof; a thermistor sandwich assembly in said case comprising a wafer-like thermistor with contact plates at opposite faces thereof in electrical contact therewith; electrical transmission means operably connected to each of said sandwich assembly contact plates for transmitting electrical energy through said sandwich assembly comprising a rigidly mounted electrical power connection, one of said sandwich assembly plates having a rigidly mounted electrical plate connection, said electrical power and plate connections being spaced apart generally accessible at said case bus bar opening means, convertible means at said case bus bar opening means operably connected bridging said electrical power and plate connections for one of transmitting electrical power directly between said connections and transmitting electrical power through capacitance between said connections.

3. In an electric motor controlling relay as defined in claim 2 in which said convertible means of said electrical transmission means includes a selectively severable bus bar transmitting electrical power directly between said connections in non-severed condition and transmitting electrical power through a connected capacitance in severed condition.

4. In an electric motor controlling relay as defined in claim 2 in which said convertible means of said electrical transmission means includes a selectively removable bus bar removably connected between said connections transmitting electrical power directly between said connections in installed condition and removable permitting installation of capacitance between said connections.

5. In an electric motor controlling relay as defined in claim 2 in which said convertible means of said electrical transmission means includes a bus bar bridging said connections and extending partially into said case through said bus bar opening means.

6. In an electric motor controlling relay as defined in claim 2 in which said convertible means of said electrical transmission means includes a selectively removable bus bar slideably attached to said connections transmitting electrical power directly between said connections in slideably attached condition and permitting attachment of a capacitor between said connections in slideably detached condition.

7. In an electric motor controlling relay as defined in claim 2 in which said convertible means of said electrical transmission means includes a selectively removable bus bar slideably attached to said connections transmitting electrical power directly between said connections in slideably attached condition and permitting attachment of a capacitor between said connections in slideably detached condition, said bus bar extending partially into said case in its slideably attached condition through said case bus bar opening means.

8. In an electric motor controlling relay of the type for controlling motor starting windings; the combination of a case having spaced generally opposed walls, each of said walls having air circulation openings formed therethrough; a thermistor sandwich assembly in said case comprising a wafer-like thermistor with contact plates at opposite faces thereof in abutting electrical contact therewith, said thermistor and said contact plates in said assembly all being positioned generally parallel to said case opposed walls, at least one of said contact plates having resiliently compressible means thereon against its thermistor face for exerting compressive forces in said assembly between said contact plates; surface means on said case opposed walls oppositely abutting said sandwich assembly contact plates for retaining said compressive assembly; electrical transmission means operably connected to each of said sandwich assembly contact plates for transmitting electrical energy through said sandwich assembly; said thermistor sandwich assembly further comprising said one contact plate resiliently compressible means including projections extending toward and in contact with said one contact plate thermistor face spacing a major part of said one contact plate from its thermistor face, the other of said contact plates having projections thereon extending toward and in contact with said other contact plate thermistor face spacing a major part of said other contact plate from its thermistor face, said contact plates constituting the sole plates in said case and the sole plates associated with cooling of said thermistor; air circulation space means including voids formed between said contact plate major parts and the respective thermistor faces by said projections creating said spacing between said contact plate major parts and said thermistor faces, positioning of said contact plates in said case and shapes of said contact plates creating other spacing within said case placing said voids in air circulation communication with said case wall openings.

9. In an electric motor controlling relay as defined in claim 8 in which said one contact plate projections include integral spring fingers extending toward and in contact with said one contact plate thermistor face, said other contact plate projections being integral projections thereon extending toward and in contact with said other contact plate thermistor face, said contact plate spring fingers and projections forming said air circulation space means voids.

10. In an electric motor controlling relay as defined in claim 8 in which said air circulation openings formed through said case opposed walls includes a plurality of holes formed through one of said case walls and a slot formed through the other of said case walls.

11. In an electric motor controlling relay of the type for controlling motor starting windings; the combination of a case; a thermistor sandwich assembly in said case comprising a wafer-like thermistor with contact plates at opposite faces thereof in abutting electrical contact therewith, at least one of said contact plates having resiliently compressible means thereon against its thermistor face for exerting compressive forces in said assembly between said contact plates; surface means on said case oppositely abutting said sandwich assembly contact plates for retaining said compressive assembly; electrical transmission means operably connected to each of said sandwich assembly contact plates for transmitting electrical energy through said sandwich assembly; said case including bus bar opening means through a wall thereof; said electrical transmission means including a rigidly mounted electrical power connection, one of said sandwich assembly plates having a rigidly mounted electrical plate connection, said electrical power and plate connections being spaced apart generally accessible at said case bus bar opening, convertible means at said case bus bar opening operably connected bridging said electrical power and plate connections for one of transmitting electrical power directly between said connections and transmitting electrical power through capacitance between said connections.

12. In an electric motor controlling relay as defined in claim 11 in which said electrical transmission means includes said convertible means being at least partially comprised of a selectively severable bus bar transmitting electrical power directly between said connections in its unsevered condition and transmitting the electrical power through capacitance oppositely connected thereto in its severed condition.

13. In an electrical motor controlling relay as defined in claim 11 in which said electrical transmission means includes said convertible means being at least partially comprised of a selectively removable bus bar transmitting electrical power directly between said connections in its installed condition and selectively removed permitting operable connections of capacitance between said connections.

14. In an electric motor controlling relay as defined in claim 11 in which said case includes spaced generally opposed walls, air circulation openings formed through each of said walls partially comprised of said bus bar opening means through one of said walls; and in which said sandwich assembly includes air circulation space means formed by voids between said thermistor faces and said contact plates and by other spaces resulting from formation of said contact plates and positioning of said contact plates within said case walls all in air circulation communication with said case wall openings, said contact plates constituting the sole plates in said case and the sole plates associated with cooling of said thermistor.

* * * * *